United States Patent [19]

Almblad

[11] Patent Number: 5,029,459

[45] Date of Patent: Jul. 9, 1991

[54] FLAT PLASTIC KEY WITH RIGID TORQUE TRANSFER INSERT

[75] Inventor: Robert E. Almblad, Scottsdale, Ariz.

[73] Assignee: Mitsubishi Corporation, Tokyo, Japan

[21] Appl. No.: 472,953

[22] Filed: Jan. 31, 1990

Related U.S. Application Data

[63] Continuation of Ser. No. 216,763, Jul. 8, 1988, abandoned, which is a continuation-in-part of Ser. No. 155,884, Feb. 16, 1988, abandoned, which is a continuation-in-part of Ser. No. 91,492, Sep. 3, 1987, abandoned.

[51] Int. Cl.[5] ..... E05B 19/02

[52] U.S. Cl. ..... 70/395; 70/406; 70/408; 264/273; 264/274

[58] Field of Search ..... 70/395, 400–402, 70/405, 406, 408, 409, 458, 460, 456 R; 76/110; 264/273, 274

[56] References Cited

U.S. PATENT DOCUMENTS 2,714,304 8/1955 Dedda ..... 70/406

FOREIGN PATENT DOCUMENTS 592908 2/1960 Canada ..... 70/456 R 2037071 2/1972 Fed. Rep. of Germany ..... 70/402

*Primary Examiner*—Lloyd A. Gall

*Attorney, Agent, or Firm*—Cahill, Sutton & Thomas

[57] ABSTRACT

A flat plastic key is designed to actuate a rotary cylinder lock having lock tumblers, an elongated key receptable for receiving the key and a rotary lock face including a rectangular lock entrance slot with spaced apart sidwalls. The key and the lock include alignable longitudinal axes. The plastic key includes a head for receiving a lock actuating input torque within a force input area. The key also includes a shank having a first end surface joined to the end surface of the head and a spaced apart second end surface. The shank is designed to extend through the lock entrance slot of the lock face. When fully inserted, the resulting area of overlap between the sides of the fully inserted key shank and the lock entrance slot define a shank torque transfer surface where torque is transferred from the shank to the sidewalls of the lock entrance slot. The key also includes a solid plastic bit and a rigid metal insert. The metal insert is embedded in the head and the shank of the key and includes a length less than the combined length of the head and the shank. The insert extends beyond the shank torque transfer surface but terminates without extending into the key bit.

12 Claims, 6 Drawing Sheets

3/4

FLAT PLASTIC KEY WITH RIGID TORQUE TRANSFER INSERT

CROSS-REFERENCE TO RELATED APPLICATIONS

This is a continuation of U.S. patent application Ser. No. 216,763, filed 7/8/88, now abandoned, which is a continuation-in-part of Ser. No. 155,884, filed 2/16/88, now abandoned, which is a continuation-in-part of Ser. No. 91,492, filed 9/3/87, now abandoned.

BACKGROUND OF THE INVENTION

1. Field of the Invention

The present invention relates to molded plastic keys, whether individual keys, or plastic card/key combinations on the order of the disclosure in my U.S. Pat. No. 4,677,835 dated July 7, 1987, and is more particularly concerned with reinforcing such keys against breaking at their shanks due to extraordinary twisting stress applied through the handles of the keys.

2. Description of Related Art

Conventional metal keys for operating tumbler locks such as in automobiles, building doors, apparatus controls, and the like, have heretofore been generally constructed throughout the shank and bit portions, and generally the handles, or head portion of a uniform thickness common with the bit thickness. Molded plastic keys have also heretofore been constructed of substantially uniform thickness throughout their length similar to comparable metal keys.

The key bit must be fairly snuggly fitted in the key slot in the cylinder plug. Looseness of the bit in the key slot might defeat proper engagement of the lock tumblers in the key notches. On the other hand, especially in the USA, to avoid difficulty in quick insertion of the key bit into the slot, the general practice has been to provide enlarged entrance dimensions. This results in the key shank often having little if any torque support when subjected to the considerable twisting stress which may occur if for any reason there is resistance to turning of the key in the lock. Such resistance may be variously caused such as by faulty cutting of the key notches, binding due to corrosion or icing, and the like. The general tendency of the user, where there is any such resistance to turning of the key in the lock, is to apply additional torque or twisting force to the key through its handle. Metal keys will generally withstand such extraordinary twisting stress.

In a normal U.S. automobile ignition or trunk lock, only about three to eight inch pounds of torque (IPT) are necessary to open the lock; non U.S. automobiles typically require higher torques. A normal uniform thickness molded plastic key will withstand up to eight to nine IPT. If greater torque is applied there is danger of breaking the plastic key shank. An average woman can apply up to seven to ten IPT and an average man can apply up to ten to fourteen IPT. Therefore, there has been some key shank breakage experienced in respect to molded plastic keys having a substantially common thickness throughout their lengths.

Molded plastic keys have been disclosed in Donald F. Almblad U.S. Pat. No. 4,637,236, and in U.S. Pat. No. 4,677,835 of the present applicant. In both of those patents the keys are shown as of a common thickness throughout their lengths.

By way of a typical disclosure of a metal key and tumbler lock, U.S. Pat. No. 4,656,851 is referred to.

SUMMARY OF THE INVENTION

The present invention provides an improved plastics material key and method of making same. The plastics material key of the present invention can be used alone, or it can be used in combination with means for holding the key, such as a card-like holder. The improved plastics material key of the present invention includes means for substantially lessening the likelihood that the plastics material key will break or fail when unusual resistance or torque is encountered when the plastics material key is utilized in a lock or the like.

To this end, the plastics material key includes means for reinforcing the key. The means for reinforcing the key increases the strength of the key over that of a key which is essentially only a plastic duplicate of a standard metal key.

In an embodiment the means for reinforcing the key includes a thickening of at least a portion of the key. Although, in a preferred embodiment portions of the shank are thickened, other areas of the key may also be thickened.

In another embodiment, the means for reinforcing is an insert which is embedded, at least partially, in a portion of the key for reinforcing the key. The insert functions to strengthen a portion of the key, e.g. the shank, when resistance or unusual torque is encountered when the key is utilized to actuate a lock.

The present invention also provides a means for molding the rigid material into a plastic material such as a key. In an embodiment, the means includes a groove in the plastic material key that allows an insert embedded therein to move within portions of the plastic material as the plastic material cools after molding. A method for so molding a plastics material key is also provided.

The means for reinforcing the plastics material key is so constructed and arranged that it does not interfere or hinder the cutting of notches or slots in the key that are necessary along at least one side of the bit to actuate the tumblers of a lock. Accordingly, the present invention provides a means for reinforcing the key that does not hinder or hamper some of the advantages of a plastic material key. For example, a plastics material key may be easier for a key cutter to cut than a corresponding metal key. However, if a rigid insert were placed within the plastics material key and extended along the entire length of the key any advantages inherent in the ability to cut a plastics material key would be lost. Furthermore, the plastics material key provides a lightweight key when compared to some typical metal keys. An extending rigid member throughout the entire length of the key would increase the weight of the key and limit some of the advantages of a plastics material key.

The present invention also provides a plastics material key having a reinforcement member that can be used with a variety of different keys. There are a variety of different key blanks having different shank and bit constructions with varying groove configurations. The present invention provides means for reinforcing plastics material key that can utilized with a majority of the known typical key structures.

An important object of the present invention is to provide a new and improved molded key constructed from a plastics material which is strengthened against torque induced breakage of the shank portion of the key.

Another object of the present invention is to provide a new and improved molded plastic key in which the shank portion is reinforced by a thickening.

A further object of the present invention is to provide a new and improved molded plastic key provided with a shank reinforcing insert.

A still further object of the present invention is to provide a new and improved molded plastics material key in which the shank is strengthened through the addition to the plastic material of a strengthening material.

In accordance with the principles of the present invention, there is provided a molded key constructed from a plastics material having a handle, a shank and a bit, and in which the shank is reinforced against breakage due to unusual torque applied through the key handle when resistance to turning is encountered after the bit is inserted into a lock.

There is also provided by the present invention a new and improved method of making a shank reinforced molded plastic key.

There is also provided an improved plastics material key and key holder.

Other objects, features and advantages of the present invention will be readily apparent from the following description of preferred embodiments thereof, taken in conjunction with the accompanying drawings, although variations and modifications may be effected without departing from the spirit and scope of the novel concepts of the disclosure, and in which:

DETAILED DESCRIPTION OF THE PRESENTLY PREFERRED EMBODIMENTS

Figure 1:
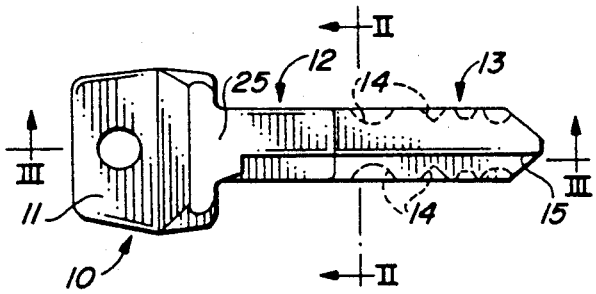
FIG. 1 is a plan view of a molded plastic key blank embodying a reinforced shank according to the present invention.
Figure 2:
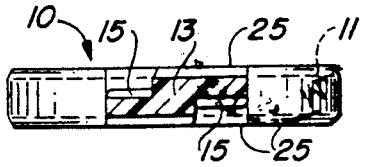
FIG. 2 is an enlarged cross-sectional detail view taken substantially along the line II—II in FIG. 1.

Referring to FIGS. 1–4, a one-piece molded plastic key 10 is disclosed having a head or handle 11, typically of substantially greater width than an integral shank 12 connecting the handle to a blade or bit 13. In this instance, the bit 13 is of the type which may have tumbler notches 14 cut along either or both edges, and for this purpose the cross-sectional geometry of the shank and bit may, as best seen in FIG. 2, be provided with longitudinal rabbet grooves 15 providing thinner margins along both edges.

Figure 4:
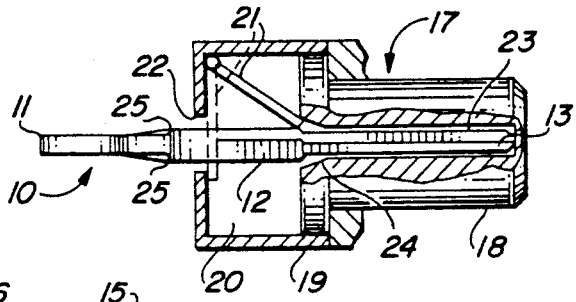
FIG. 4 is a generally schematic illustration of the key of FIG. 1 located operatively within one form of tumbler lock.
Figure 3:
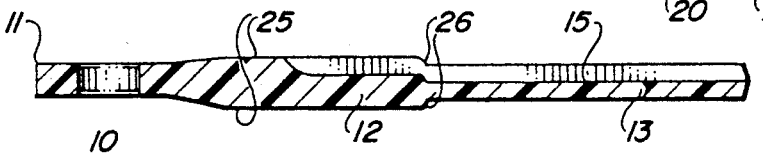
FIG. 3 is an enlarged longitudinal sectional detail view taken substantially along the line III—III in FIG. 1.
Figure 6:
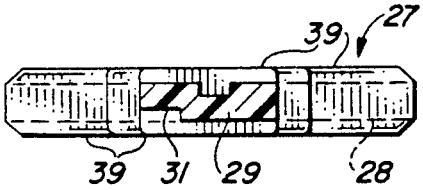
FIG. 6 is an enlarged transverse sectional detail view taken substantially along the line VI—VI in FIG. 5.

Illustratively, the key 10 has the shank 12 and the bit 13 elongated for reception in a conventional rotary cylinder tumbler lock 17 (FIG. 4) having a tumbler barrel cylinder or plug 18 extending from a housing 19 defining a chamber 20 of ample size to accommodate a spring biased flapper closure 21 which is adapted to be pushed aside by the key from the dashed position to the full line position when the key is inserted through a rectangular entrance slot 22. It may be noted that the entrance slot 22 affords ample clearance to facilitate entry of the key therethrough for reception in a key slot 23 which for practical reasons is fairly closely dimensioned relative to the key bit 13. A tolerance clearance of only about 0.005 inch is desirable between the bit 13 and the slot 23. An entrance 24 into the key slot 23 flairs towards its outer end in a generally lead-in cam fashion to facilitate reception of the key bit 13 into the slot 23. FIG. 4 illustrates that bit 13 fits closely in slot 23, but that a small gap exists between the flat sides of shank 12 and the parallel oriented sidewalls of rectangular lock entrance slot 22. As a result, the application of an extraordinary input torque through the handle 11 after the key bit 13 has been introduced into the slot 23 permits the key shank 12 to twist relative to key bit 13 because there is no torque support for the shank 12 in the gap between the sides of the shank and the sides of the lock entrance slot 23.

To equip the shank 12 against twisting, torque-stressed breakage, the shank is reinforced. For example, where there is ample lock entrance clearance between shank 12 and entrance slot 22, e.g., as in FIG. 4, reinforcement for the shank 12 may be advantageously provided by an integrally molded thickening 25 of the shank. Such thickening 25 is preferably accomplished throughout the length of the shank from adjacent to but clear of the proximal area of the bit 13 to be notched. Thus, increasing the thickness of shank 12 without increasing the thickness of bit 13 strengthens shank 12 without interfering with the close tolerance fit of bit 13 in key slot 23. By preference, the thickening 25 of shank 12 is effected about 0.020 inch on both sides of the shank 12 and extends to at least a limited distance onto the adjacent portion of the handle 11.

For utmost integrity of reinforcement, the thickening 25 extends over substantially the entire width of both the shank 12 and the portion of the handle 11 provided with the thickening. At the bit end of the shank 12, the thickening 25 may end abruptly, as shown at 25 (FIG. 3) as close as practicable to the area of the bit to be notched so as to gain maximum advantage the thickening for its reinforcing function. At the handle end of the thickening 25 it may taper for smoothness both at the sides and at the handle end, substantially as visualized in FIGS. 2 and 3. Although the thickening 25 could cover the entire handle 11 on both sides of the handle, that is not necessary and plastic material is saved by having the thickening extend only partway onto the remainder of the handle. In any event, the thickening provides ample digital grip area for transmission of an input torque from the handle to the reinforced shank.

It should be noted that in thickening the keys of the present invention to provide reinforcement, it may be desirable, in those instances where one is able, to thicken the plastic key so that it is thicker than a standard metal key. For example, where the tumbler lock entrance slot for receiving the key shank is sufficiently large, it may be possible to thicken the plastic key so that it is thicker than a standard metal key. It should also be appreciated that although the shank is thickened in some embodiments of the present invention, it is not necessary to simply thicken the shank. For example, the head and shank and blade can all be thickened to the maximum extent permitted by the lock.

In FIGS. 5–8, a modified shorter molded plastic key 27 is depicted having a handle 28, a short shank 29 and a bit 30 of a suitable length for the intended purpose. In this instance, the bit 30 has a rabbet groove 31 along only one side providing a thin longitudinal side area for receiving tumbler pin notches 32. The key 27 is especially adaptable for operating a tumbler lock 33 of the kind having an escutcheon 34 providing an entrance with lead-in surfaces 35 and 37 of wider dimensions than a key slot 38 within the plug of the lock and into which the bit 30 fits fairly snuggly.

Reinforcement of the key 27 against torque breakage of the shank 29 is, similarly as described in connection with the key 10 in FIG. 1, provided by means of thickening 39 which stops short of the notch 32 located in the bit 30 nearest to the shank. In that portion of the thickening 39 which extends over onto the handle 28 on each face of the key, the thickening tapers toward the handle substantially as shown. The thickening 39 on each face of the key extends from side-to-side of the key as is clearly evident in FIG. 6.

Figure 5:
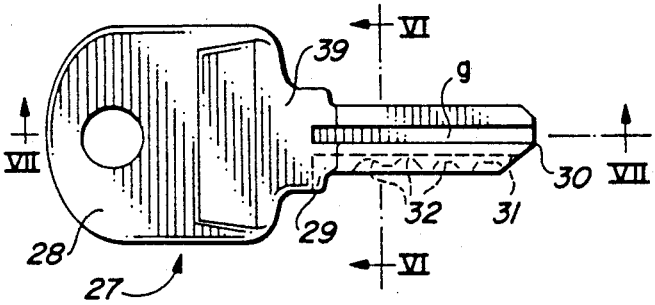
FIG. 5 is a plan view of a modified form of molded plastic key embodying the present invention but having a somewhat shorter shank than in the form of FIG. 1.
Figure 8:
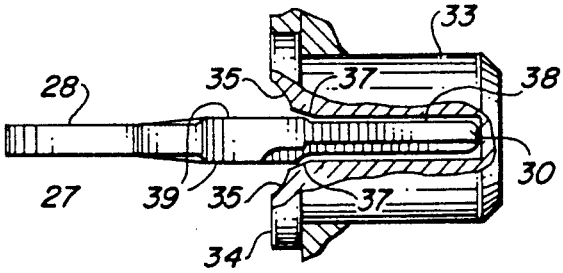
FIG. 8 is a schematic illustration showing the key of FIG. 5 in a typical tumbler lock.
Figure 7:
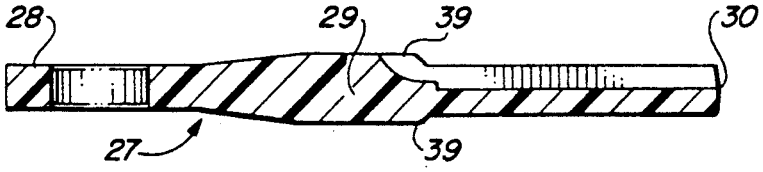
FIG. 7 is an enlarged longitudinal sectional detail view taken substantially along the line VII—VII in FIG. 5.

As illustrated in FIG. 5, the groove g that runs along a portion of the length of the blade of the key 27, for indexing with internal configurations of a slot of a tumbler, does not extend all the way to a head end of the shank 29. This functions to reinforce the shank 29 and make it stiffer. In this regard, it should be noted that by terminating the groove g prior to an end portion of the shank 29 to create a shortened groove, one can reinforce a key having such a shortened groove. Accordingly, if desired, the shank of the plastic key can be reinforced merely by shortening the length of the groove without the necessity of making the shank thicker than remaining portions of the key. As shown in FIGS. 5, 7 and 8, the shortened groove "g" ends at a shortened groove termination point spaced well away from the location where the shank joins the head.

In the modification depicted in FIGS. 9–13, a reinforced shank molded plastic key 40 is provided which is especially suitable for use with tumbler locks that do not have the entrances into the key slot of significantly larger cross sectional dimensions than the key slot. Such tumbler locks are especially prevelant outside of the U.S.A., particularly, in automobile locks. To this end, the key 40 has a handle 41 which may be thicker than a short shank 42 and a bit 43 of suitable length. The shank 42 and the bit 43 may have one or more longitudinally extending coding grooves 44, and at least one rabbet groove 45 along one longitudinal side of the bit 43 providing a relatively thin longitudinal side area 47 for having tumbler notches 48 cut therein to enable opening an intended tumbler lock (not shown).

In order to provide reinforcement against torque breakage of the shank 42 adjacent to the handle, a highly torque resistant reinforcing insert 48 is embodied in the shank 42 and the adjacent portion of the key handle. In a preferred construction the insert 48 comprises a thin hard metal member, desirably a hard steel stamping including a shank-reinforcing extension or finger 49 projecting from a body 50 having a head portion 51 at the opposite end from the finger 49. Rounded, i.e. radiused, corners 51*a* on the head 51 and similarly rounded corners 50*a* on the body 50 enhance molded integrity of the plastic key 40 and the insert 48.

Figure 9:
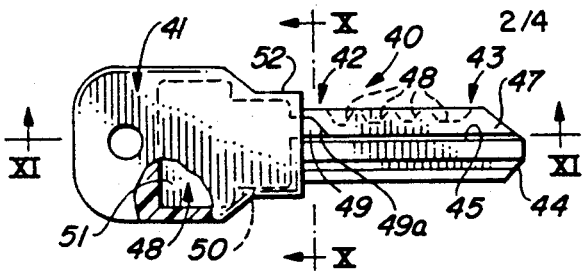
FIG. 9 is a plan view of another modified form of molded plastic key embodying a reinforced shank according to the present invention.
Figure 10:
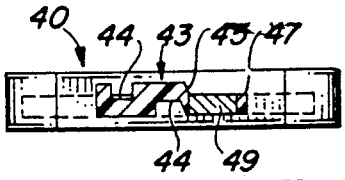
FIG. 10 is an enlarged transverse sectional detail view taken substantially along the line X—X in FIG. 9.
Figure 11:
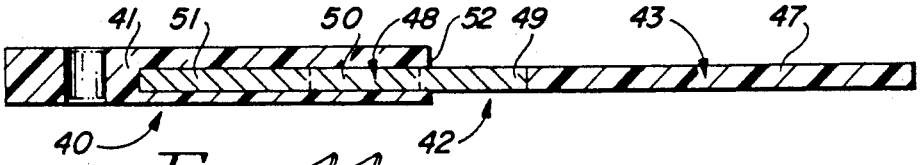
FIG. 11 is an enlarged longitudinal sectional detail view taken substantially along the line XI—XI in FIG. 9.
Figure 12:
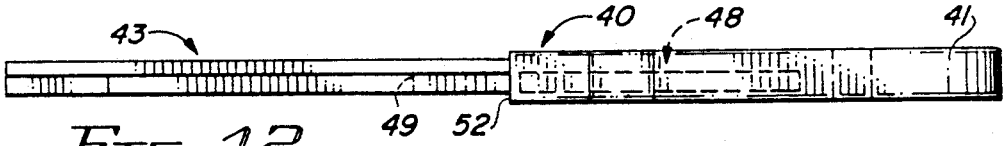
FIG. 12 is an enlarged side elevational view of the key in FIG. 9.
Figure 13:
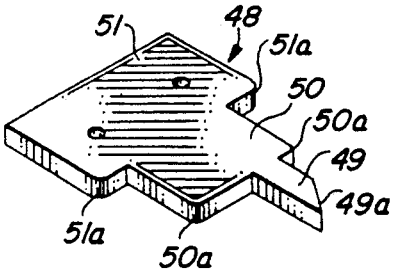
FIG. 13 is a perspective view of the reinforcing insert present in the key of FIG. 9.
Figure 14:
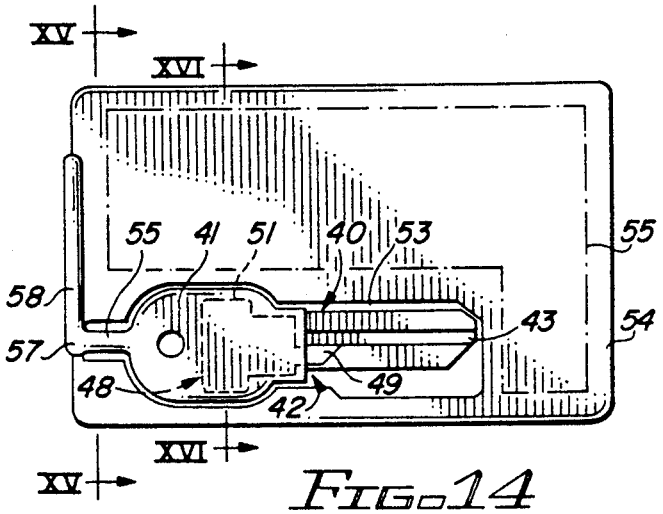
FIG. 14 is a plan view of a plastic card/key combination embodying a key substantially according to FIG. 9.

The reinforcing finger 49 is of a width and thickness to be received in the shank portion of the tumbler pin notch-receiving area 47. In width, the finger 49 is desirably slightly less than the width of the key area 47 so as to maintain integrity of the shank portion 42 of the key relative to the key handle 41 and the bit 43. The thickness of the reinforcing finger 49 and the key area 47 is preferably identical, and the opposite faces of the finger 49 may be exposed at the opposite faces of the area 47, whereby the finger 49 may be substantially in direct torque force contact with the entrance end of a tumbler lock key slot within which the shank 42 is received after the bit 43 has been fully inserted in the slot for operating the lock. The length and terminal end of the finger 49 are calculated to extend the maximum permissible distance into the shank and the shank end of the area 47, having regard to the nearest tumbler pin notch 48. To gain maximum extension, a slanted or oblique terminal edge 49*a* is provided on the finger 49 to afford a clearance relative to the nearest notch 48 that may be cut in the area 47. As best seen in FIG. 9, the diagonal terminal edge 49*a* terminates short of the place for the nearest notch 48, leaving a narrow separating portion of the area 47 between the edge 49*a* and the nearest notch 48. Through this arrangement interference from the finger 49 with efficient cutting of the notches 48 is avoided.

Desirably the body portion 50 of the insert 48 is dimensioned to be embedded within a stop portion 52 of the handle 40 and which stop portion abuts the outer end of a lock when the key shank is fully received within a lock. The head end portion 51 of the insert 48 is dimensioned to be embedded within the key handle 41 and is desirably of a length which will occupy about half the length of the handle, and is of a sufficient width for a thorough torque transmission connection between the finger 49 and the area of the handle 41 which is digitally grasped when turning the key 40 for operating a lock.

As will be noted in FIGS. 9–12, the flat insert 48 is substantially thinner than the key handle 41. The shank 42, and the main thickness of the bit 43, and the body portion 50 and the head portion 51 are respectively sufficiently narrower than the stop portion 52 and the handle 41, so that as moldably imbedded in the handle 41 the insert is thoroughly integrated in the handle. Such molded integration and integrity of the key/insert unit is enhanced by having the handle 41 substantially thicker than the insert 48.

Although the key 40 may be utilized independently, it may also provide the key for a plastic card/key combination as depicted in FIGS. 14–17. To this end, the key 40 is located within a complementary recess 53 within a preferably generally wallet size holder 54. Desirably the recess 53 is located as conveniently near one side of the card 54 so that the remaining area of the face, or both faces, of the card can be utilized for any desired legends or indicia as schematically shown at 55.

Figure 15:
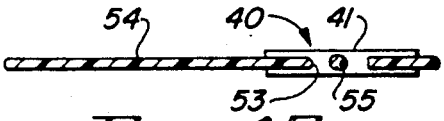
FIG. 15 is a sectional detail view taken substantially along the line XV—XV of FIG. 14.
Figure 16:
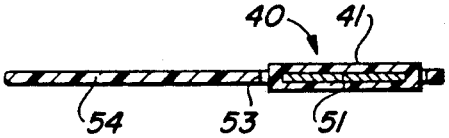
FIG. 16 is a sectional detail view taken substantially along the line XVI—XVI of FIG. 14.
Figure 17:
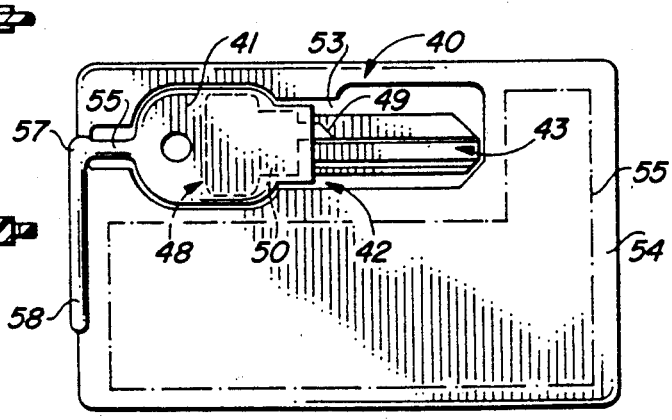
FIG. 17 is a plan view of the opposite side of the combination plastic card/key combination of FIG. 14.

For retaining the key 40 integrally with the card 54, integral multidirectional hinge means 55 is provided comprising a unitary part of the molding and formed from the same material as the key and the molded card, and integrally connecting an edge of the key head or handle 41 to an edge of the card 54 in the recess 53. Desirably the hinge means 55 comprises a generally elongated element which permits the key to be not only swung out of the plane of the card 54 but also to be twisted relative to the card on and about the hinge without breaking away from the card. In the preferred form, the hinge 55 comprises a generally rod shaped element which may be of cylindrical cross section and is longer than its diameter. Although the hinge 55 may be of slightly smaller diameter than the thickness of the head 41, as best seen in FIG. 15 the hinge diameter may be slightly greater than the thickness of the card 54. A reinforcement extension 57 extends from the attached end of the hinge 55 onto the adjacent portion of the card 54 and is connected to a reinforcing rib 58 which runs along the edge of the card and stiffens the card in this area against undue flexibility.

Referring now to FIGS. 18–21, a reinforced shank molded plastic key 60 is depicted which, in general respects, is similar to the key 40 in FIG. 9, but differs therefrom in that tumbler notching 48 is effected along both edges of the bit. To this end, the key 16 has a handle 61, a shank 62 and a bit 63. The bit 63 is symmetrical in cross section and has along each longitudinal side a generally rabbet coding groove 64, and the grooves face alternately relative to the opposite faces of the bit 63. Along each of the grooves 64 there is a longitudinal side area 65 which is about half the thickness of the body of the bit 63. Tumbler notches 67 are adapted to be cut in the area 65.

Reinforcement against torque breakage of the shank 62 is provided by a high torque resistant reinforcing insert which is preferably in the form of a steel stamping 68. A body portion 69 and a head portion 70 of the reinforcing insert 68 are fully embedded in the handle 61. For thorough interlocking of the head portion 70 within the handle 61, a transverse interlock slot 71 in the insert head 70 provides for a molded interlock 72 of the plastic key handle.

Figure 18:
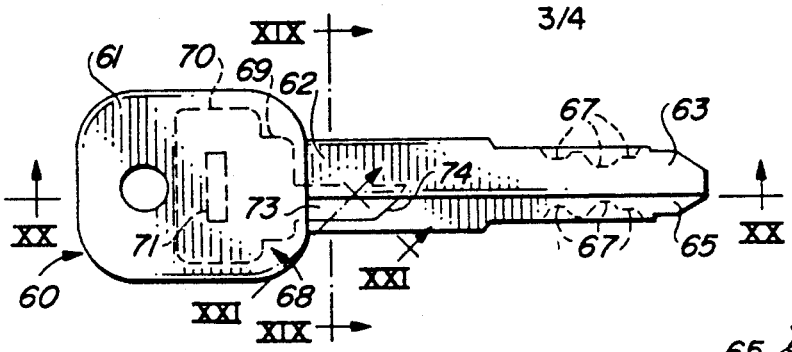
FIG. 18 is a plan view of still another modified form of molded plastic key embodying a reinforced shank according to the present invention.
Figure 19:
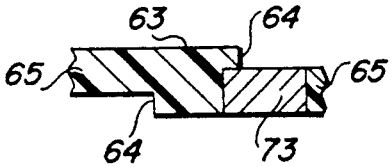
FIG. 19 is an enlarged fragmentary sectional detail view taken substantially along the line XIX—XIX in FIG. 18.
Figure 20:
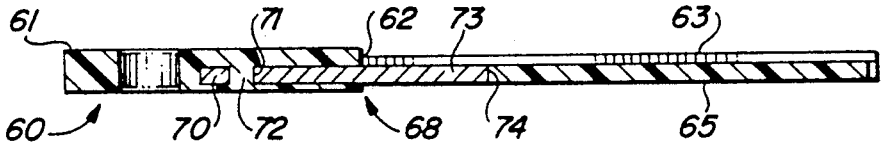
FIG. 20 is an enlarged longitudinal sectional detail view taken substantially along the line XX—XX in FIG. 18.
Figure 21:
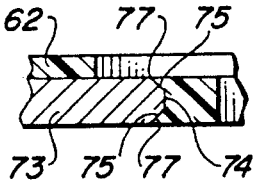
FIG. 21 is an enlarged fragmentary sectional detail view taken substantially along the line XXI—XXI in FIG. 18.

In a preferred construction, the insert 68 is of a thickness no greater than the thickness of at least one of the notch-receiving areas 65 into which a reinforcing extension in the form of a finger 73 of the insert 68 projects from the insert body 69. As best seen in FIGS. 19 and 20, the finger 73 is so aligned with the associated bit area 65 that opposite faces of the finger 73 are exposed at the opposite faces of the area 65 for similar reasons as expressed in connection with the finger 49 in FIG. 9. For adequate torque resistant strength in the finger 73, it is preferably wider than the width of the associated key area 65 and part of the finger is therefore moldably accommodated within the adjacent portion of the body of the shank 62. Such body-embedded portion of the finger 73 is desirably the longer dimension of the finger where the finger has, as shown in FIG. 18, a slanted or oblique terminal edge 74. Whether or not the terminal edge 74 is oblique, it is desirably coined from opposite faces of the finger, as best seen in FIG. 21, to provide tapered or bevelled surfaces leading to the edge 74. This provides a thinner section for the finger 73 adjacent to the edge 74, so that there will be interlocking overlaps 77 of the molded plastic material of the bit 63 in engagement with the tapered surfaces 75. This provides good anchorage of the terminal end of the finger 73 within the molded material and maintains sound structural integrity of the moldably joined key 60 and the insert 68.

Figure 22:
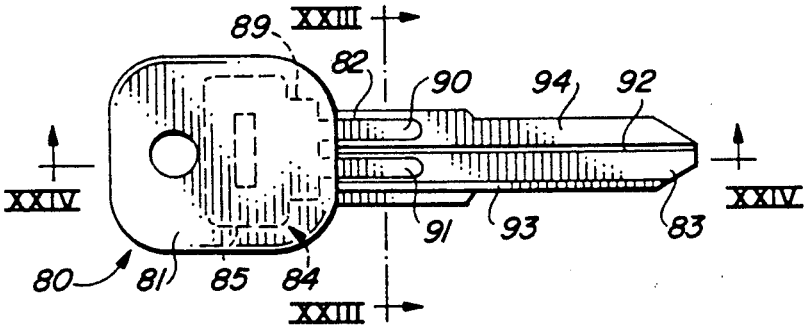
FIG. 22 is a plan view showing yet another modified form of molded plastic key embodying a reinforced shank according to the present invention.
Figure 23:
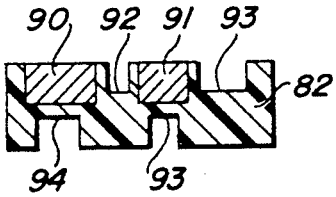
FIG. 23 is an enlarged cross-sectional detail view taken substantially along the line XXIII—XXIII in FIG. 22.
Figure 24:
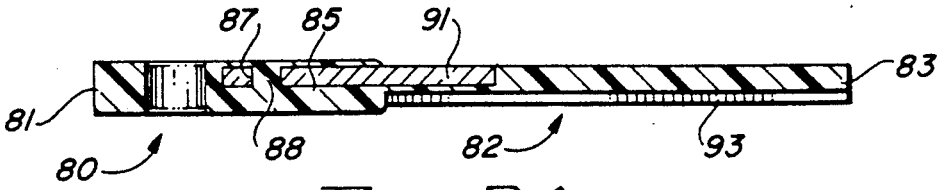
FIG. 24 is an enlarged longitudinal sectional detail view taken substantially along the line XXIV—XXIV in FIG. 22.

As shown in FIGS. 22-24, a key 80, similarly as the keys 40 and 60 comprises a handle 81 which is desirably thicker than a shank 82 and a bit 83, with a metal reinforcing insert 84 embedded in the handle and shank. A head end portion 85 of the insert is embedded in the handle 81, with an interlock slot 87 providing for a molded plastic interlock 88. From the head 85 projects an insert body 89 and, in this instance, a pair of spaced parallel reinforcing fingers 90 and 91 project from the body 89 into the key shank 82. The finger 90 may be slightly wider than the finger 91, and in the shank area between the fingers may be a longitudinal coding groove extending throughout the length of the bit 83 as well as the shank 82. There may additional longitudinal coding grooves 93 in the shank 82 and running on along the bit 83. A flat longitudinal tumbler pin notch-receiving area 94 runs along the side of the bit 83 which is in alignment with reinforcing finger 90. At the face of the shank 82 which may make contact with an entrance into a key slot in a lock with which the key 80 may be used, the finger 90 as well as the finger 91 have their face areas exposed as contact surfaces. It may be observed that if it were not for the coding groove 92, the two fingers 90 and 91 could be constructed solidly in one piece. This emphasizes the versatility of the fingered reinforcing insert concept for plastic keys.

Figure 25:
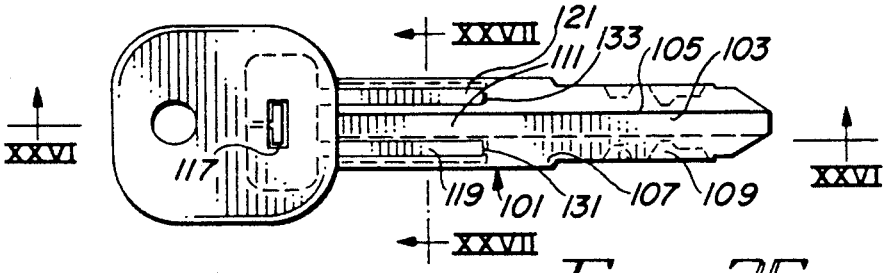
FIG. 25 is a plan view showing another embodiment of the molded plastics material key embodying a reinforced shank of the present invention.
Figure 26:
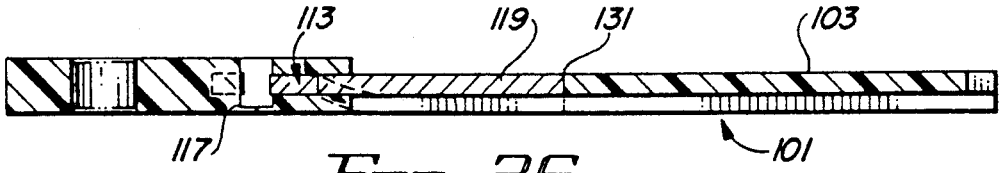
FIG. 26 is an enlarged cross-sectional detail view along lines XXVI—XXVI of FIG. 25.
Figure 27:
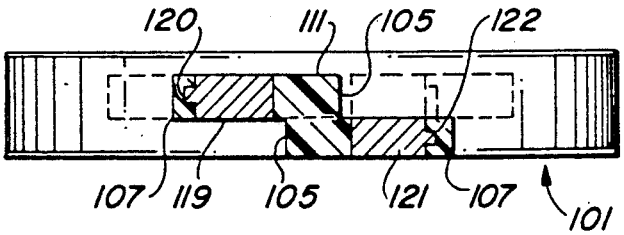
FIG. 27 is an enlarged cross-sectional detail view along lines XXVII—XXVII of FIG. 25.

Referring now to FIGS. 25-27, another embodiment of a molded plastics material key 101 of the present invention is illustrated. The key 101 is somewhat similar to the key 60 illustrated in FIG. 18 in that the bit 103 is symmetrical in cross section and has along each longitudinal side a generally rabbet coding groove 105, and the grooves face alternately relative to the opposite faces of the bit 103. Along each of the grooves 105, there is a longitudinal side area 107 that is approximately half the thickness of the remaining portion of the body of the bit 103. The side area 107 is so constructed and arranged that tumbler notches 109 can be cut therein.

Due to the construction of the molded plastics material key 101, the shank 111 of the key is susceptible to twisting and breakage due to torque when the key 101 is inserted in the slot of a tumbler and twisted and unusual resistance is encountered. The key 101 is especially susceptible at the side areas 107 of the shank 111.

Figure 28:
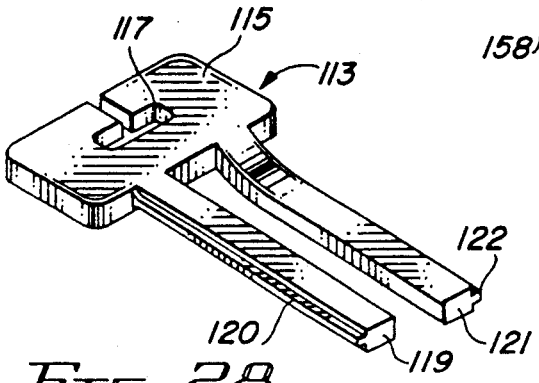
FIG. 28 is a plan view showing the insert that is embedded in the key of FIG. 25.

To reinforce the shank 111 against torque breakage, a high torque reinforcing insert 113 is provided. As illustrated in FIG. 28, the insert 113 includes a head portion 115 having an interlock slot 117. As discussed in detail below, the interlock slot 117 ensures that the insert is securely embedded within the key 101.

The insert 113 further includes, extending from the head 115, a pair of fingers 119 and 121. The fingers 119 and 121 are constructed so that they are offset from each other. To this end, the fingers 119 and 121 do not lie within the same horizontal plane when the insert 113 is in a horizontal position as illustrated in FIG. 28. In the preferred embodiment illustrated, one of the fingers 121 extends out of a horizontal plane defined by the remaining portions of the insert 113. As illustrated in FIG. 27, this construction allows one of the fingers 119 and 121 to be received within each side area 107 of the shank 111 when the insert 113 is embedded in the key 101. Due to the construction of the key 101 the longitudinal side areas 107 do not lie within the same horizontal plane. Accordingly, if the fingers 119 and 121 of the insert 113 were not offset with respect to each other they could not effectively be received within the side areas 107 when the insert 113 was embedded within the key 101. The construction of the insert 113 affords the key 101, and specifically the shank 111, increased resistance to torque breakage.

As illustrated in FIGS. 25-27, the insert 113 is designed to be embedded in the key 101. To this end, as previously stated, the head 115 of the insert 113 includes an interlock slot 117. When the insert 113 is embedded in the key 101, the interlock slot 117 functions to ensure that the insert is securely embedded therein. In this respect, the slot 117 allows the plastics material, from which the key 101 is constructed, to form a mold interlock within the slot 117 securing the insert within the key 101.

In the embodiment of the insert 113 illustrated in FIG. 28, the fingers 119 and 121 of the insert 113 include extending flange portions 120 and 122, respectively. The flange portions 120 and 122 of the fingers 119 and 121, respectively, are of a reduced thickness as compared to the remaining portions of the fingers 119 and 121. The flange portions 120 and 122 help to ensure that the insert 113 is secured within the key 101. In the preferred embodiment illustrated in FIGS. 26 and 28, the main portion of the fingers 119 and 121 has a thickness that is approximately the same as the side area 107 of the shank 111. Therefore, when the insert 113 is embedded in the key 101, the top and bottom surfaces of the fingers 119 and 121 may be exposed at the respective top and bottom surface of the side area 107, or lie just below the surface thereof. As illustrated in FIG. 27, the reduced thickness area of the flange portions 120 and 122 helps ensure that the fingers 119 and 121 are securely embedded in the key 101 by providing an area that can interlock with the molded side areas 107.

Because the plastic material from which the key 101 is made will shrink, but the rigid insert 113 will not, especially if it is constructed from metal, it is necessary to put a slot 131 and 133 at the end portion of the legs 119 and 121. The slots 131 and 133 allow the plastic to shrink during the molding process and the legs 119 and 121 will slide into the slots. If no slots were provided, stress and warping of the key could possibly occur.

Preferably, the insert 113 is constructed from a substantially rigid material such as metal. However, it will be appreciated that the insert 113 can be constructed from any material that will reinforce or afford increased strength to the key 101 and specifically the shank area 111. In a preferred embodiment, the insert 113 is constructed from steel.

Molded plastics material keys of the kind described can be formed from an acetal resin, comprising a polymerized formaldehyde formulation, such as can be obtained from E. I. DuPont De Nemours & Company under the trademark "Delrin 500".

As to the reinforcing inserts for the keys, suitable material comprises sheet steel stampings such as cold rolled steel which can be hardened if desired, or a C1095 spring steel annealed and hardened to 55–57 Rockwell prior to molding in place in the plastic keys.

Figure 29:
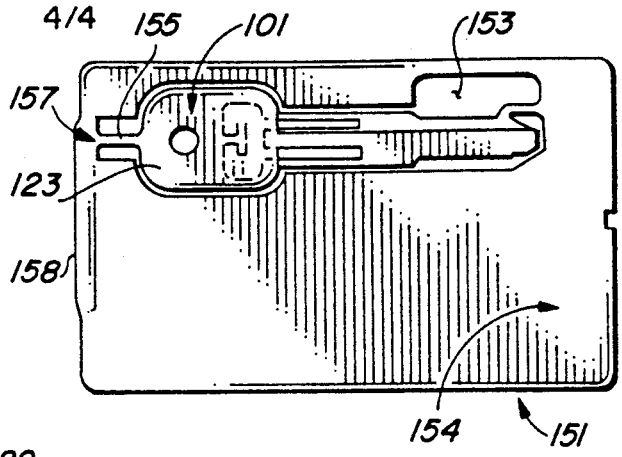
FIG. 29 is a plan view of a plastic card/key combination embodying a key substantially according to FIG. 25.

Referring now to FIG. 29, although the key 101 can be utilized independently and retained, if desired, on a key ring or like retaining apparatus, the key 101 can be part of a plastics material card/key combination 151. To this end, the key 101 is located within a complementary recess 153 within a substantially card shape holder 154. Although only one key 101 is illustrated as being located within the holder 154 if desired two or more keys can be located therein.

For retaining the key 101 within the card 154, in the embodiment illustrated, integral multidirectional hinge means 155 is provided. The hinge means 155 includes a unitary part of the molding and is preferably formed from the same material as at least a portion of the key 101 and card 154. The hinge integrally connects an edge of the key head 123 or handle to an edge of the card 154 in the recess 153.

Preferably the hinge means 155 comprises a generally elongated element that permits the key 101 to not only be swung out of a plane of the card 154 but also to be twisted relative to the card, on or about the hinge means 155, without breaking away from the card 154.

In the preferred embodiment illustrated, the hinge means has a generally rod shaped element. To stiffen the card 154, in the embodiment illustrated, the card includes a reinforcement extension 157 that extends from the attached end of the hinge 155 onto an adjacent portion of the card 154 and is connected to a reinforcing rib 158 that runs along the edge of the card.

Although in the embodiment illustrated key 101 is secured to the card 154 by hinge means 155, other means of coupling the key 101 to the card 154 can be implemented. For example, the key can be removably secured to the card so that it can be removed from the card and then later securely replaced within the recess of the card.

Figure 30:
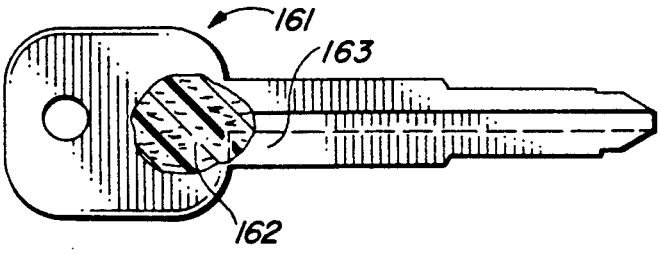
FIG. 30 is a plan view showing another embodiment of the molded plastic key embodying a reinforced shank of the present invention with parts broken away.

Referring now to FIG. 30, another embodiment of the present invention is illustrated. In this embodiment, the key 161 is not only constructed from a plastics material but also includes a fibrous reinforcement 162 molded therein. The fibrous reinforcement 162 adds strength to the key 161, and specifically the shank 163 of the key. The fibrous reinforcement provides a resistance to torque breakage when the key 161 encounters resistance when it is inserted in a lock and twisted. Examples of some fibrous reinforcement material that can be utilized to strengthen the key 161, and specifically the shank 163, include: Kevlar aramid fibers; carbon fibers; glass fibers; thermoplastic fibers, such as polyester and nylon; and hybrid composites such as aramid/carbon, aramid/glass, aramid/carbon/glass, and carbon/glass. The fibers can be directionally oriented or randomly oriented depending on the molding process chosen for constructing the key 161.

Carbon fibers are especially useful due to their high-strength and high modulus. Furthermore, carbon fibers can be molded into the plastic key 161 through injection or compression molding as well as by lamination. Glass fibers also are useful in that plastic materials reinforced with glass fibers exhibit high strength-to-weight ratios and dimensioned stability. Similarly, glass fibers can be provided as a laminate or through compression or injection molding. Thermoplastic fibers are particularly useful especially in those areas of high-shear processing such as in injection molding processes. The hybrid compounds are especially useful due to their light-weight, higher modulus, compressive strength, and flexural strength, and high impact resistance and fracture toughness. Furthermore, some of the hybrids have very good processing characteristics.

Figure 31:
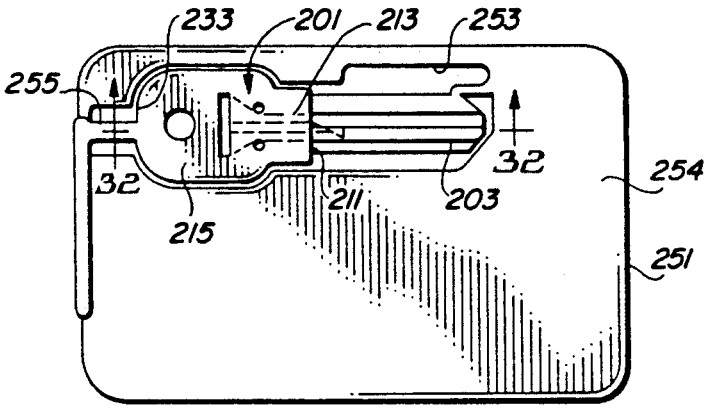
FIG. 31 is a plan view of a plastic card/key embodying another embodiment of the molded plastics material key having a reinforced shank of the present invention.

Referring now to FIGS. 31–35, a further embodiment of the key and means for reinforcing is illustrated. As illustrated in FIG. 31, the key 201 can be, if desired, part of a plastics material card/key combination 251. To this end, the key 201 is located in a complementary recess 253 within a substantially card-shaped holder 254. Of course, although only one key 201 is illustrated as being located within the holder 254, if desired, two or more keys can be located therein.

For retaining the key 201 within the card 254, in the embodiment illustrated, an integral multi-directional hinge means 255 is provided. The hinge means 255 includes a unitary part of the molding and is preferably formed from the same material as at least a portion of the key 201 and the card 254. The hinge means 255 integrally connects an edge of the key head 233 or handle to an edge of the card 254 in the recess 253. Preferably, the hinge means 255 comprises an elongated element that allows the key 201 to be swung out of the plane of the card 254 and also twisted relative to the card without breaking away from the card. Although the key 201 is illustrated in this embodiment as being secured to the card 254 by hinge means, other means of retaining the key to the card can be utilized.

As illustrated, the key includes a head portion 215, shank portion 211, and a bit portion 203. A rigid insert 213 is embedded within portions of the head 215 and shank 211 of the key 201. The rigid insert 213 reinforces the shank 211 against breakage due to torque when the key 201 is inserted in a slot of a tumbler and twisted and unusual resistance is encountered.

Figure 35:
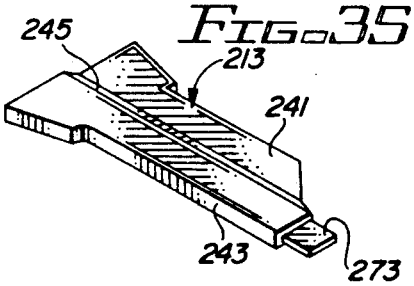
FIG. 35 is a perspective view of the rigid insert embodied in the molded plastics material key of FIG. 32.

The rigid insert 213, as specifically illustrated in FIG. 35, includes a body portion that includes two offset sides 241 and 243 that are connected by a center portion 245. The offset sides 241 and 243 are constructed so that they lie in different planes with respect to a thickness of the shank 211. This allows the side members 241 and 243 of the rigid insert 213 to be located in different thickness planes of the key 201, and specifically the shank 211. An advantage of this construction is that it allows the rigid insert 213 to be located in a key, such as that illustrated in FIGS. 31–34, that includes a groove 249 running along at least a portion of the length of the bit 203. Such grooves are especially common in house keys.

Figure 32:
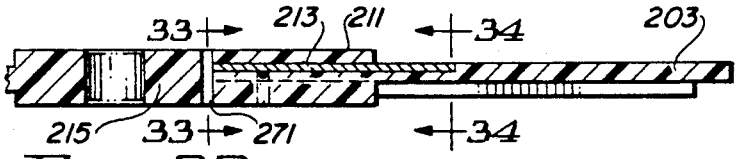
FIG. 32 is a cross-sectional view of the molded plastics material key of FIG. 31 taken along lines XXXII—XXXII of FIG. 31.
Figure 33:
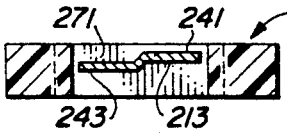
FIG. 33 is a cross-sectional view of the molded plastics material key of FIG. 32 taken along lines XXXIII—XXXIII of FIG. 32.
Figure 34:
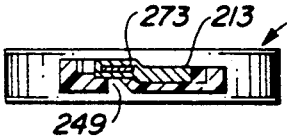
FIG. 34 is a cross-sectional view of the molded plastics material key of FIG. 32 taken along lines XXXIV—XXXIV of FIG. 32.

Referring to FIG. 32, the key 201 includes an opening or slot 271 in the head 215 thereof. The slot 271 provides two functions. In molding the key 201, the slot 271 functions to provide a shelf for supporting the rigid insert 213 within the mold prior to, and during, the molding of the plastics material around the rigid insert 213.

Furthermore, the slot 271 provides means for stress relieving the key 201 during the molding process. During the molding process, the plastics material as it cools shrinks. For example, "Delrin" will shrink up to approximately 2%. If the rigid insert 213 is a metallic material, or other material that does not correspondingly shrink during the cooling process, and if a stress relief means were not provided, the rigid insert could cause the resultant key to warp. Accordingly, in the embodiment illustrated, means are provided for stress relieving the rigid insert 213 as the plastic of the key shrinks.

The slot 271 functions to stress relieve the key 201 by providing an opening or path through which the rigid insert 213 can move as the plastics material shrinks. Accordingly, as the plastic shrinks, the rigid insert 213 will be forced upwardly into the slot 271 substantially preventing the key 201 from deforming. As illustrated in FIG. 40*a*, if desired the slot 571 does not have to extend through the thickness of the key but can be a groove that does not extend through the entire thickness of the key.

As illustrated in FIG. 35, the side members 241 and 243 of the rigid insert 213 are offset from each other from a front end to a back end of the rigid insert 213. This provides a means for ensuring that the rigid insert 213 easily slides, or moves, upwardly, towards the head 215 of the key 201 within the plastics material as the key cools after molding.

As illustrated in FIG. 35, the front end of the rigid insert 213 includes a flange 273 having a reduced cross-sectional thickness. The flange 273 insures that an interlock fit is produced between the rigid insert 213 and the plastic material of the key 201. As illustrated in FIG. 32, in certain embodiments of the rigid insert 213, at least a portion of the rigid insert 213 may be coplanar, or approximately coplanar, with a plane of the bit 203. Accordingly, to ensure that the rigid insert 213 is locked within the shank 211 and bit 203 of the plastics material key 201, the reduced cross-sectional thickness flange 273 is provided to afford an interlocking fit.

Due to the offset construction of its sides 241 and 243, the rigid insert 213 illustrated in FIGS. 31–35 has been found to be especially adapted for use in a house key.

Figure 38:
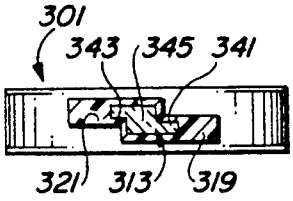
FIG. 38 is a cross-sectional view of the molded plastics material key of FIG. 36 taken along lines XXXVIII—XXXVIII of FIG. 36.
Figure 36:
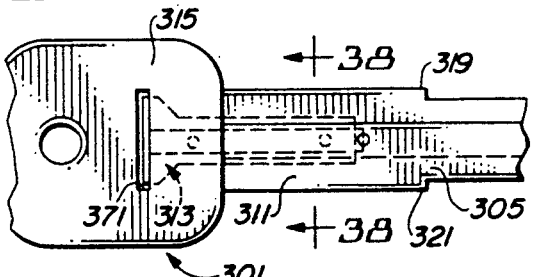
FIG. 36 is a plan view of another embodiment of a molded plastics material key having a rigid insert of the present invention.
Figure 37:
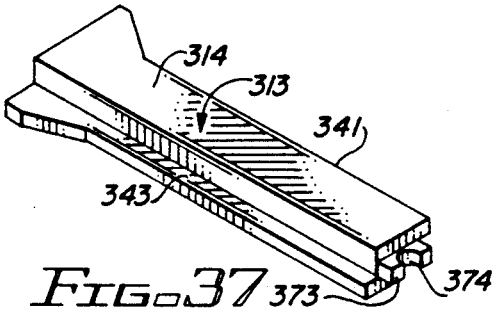
FIG. 37 is a perspective view of the rigid insert embodied in the molded plastics material key and insert of FIG. 36.

Referring now to FIGS. 36–38, a further embodiment of a molded plastics material key and reinforcing means of the present invention is illustrated. As illustrated, again, the plastics material key 301 includes a head portion 315, shank portion 311, and bit portion 305. A rigid insert 313 for reinforcing the shank is embedded within a portion of the head 315 and the shank 311 of the plastics material key 301. As further illustrated, as in the previous embodiment, the head 315 includes a slot 371 or hole that provides means for supporting the insert 313 during molding. The slot 371 further functions to provide means for stress relieving portions of the key adjacent the insert 313 so that the key 301 does not substantially deform as the plastics material of the key cools after molding.

The embodiment of the rigid insert 313 illustrated has a substantially Z-shaped cross-section. To this end, the rigid insert 313 includes a body portion 314 having extending side portions 341 and 343 having a reduced cross-sectional thickness. These side portions 341 and 343 are located in planes offset from each other with respect to a thickness of the shank 311. Accordingly, the side portions 341 and 343 can be received within reduced thickness offset side portions 319 and 321 of the molded plastics material key 301. This construction allows the rigid insert 313 to be utilized with keys that have longitudinal side areas that do not lie within the same horizontal plane. As illustrated, the offset side portions 341 and 343 extend all the way from one end of the rigid insert 313 to approximately a second end allowing the insert relatively easy movement into a portion of the slot 371 during the shrinking of the plastics material of the key 301 after molding.

Referring to FIG. 37, as illustrated, preferably, the rigid insert 313 includes an extending flange portion 373. As in the previously discussed embodiment, the flange 373 provides an interlock with the plastics material of the key 301. Again, because in certain embodiments of the key 301 and rigid insert 313, the extended side portions 341 and 343, or body portion 314 of the rigid insert, may be coplanar, or approximately coplanar, with a portion of the bit 303 of the key 301, the flange 373 ensures that the rigid insert 313 is secured within the key.

In the embodiment illustrated, the flange 373 includes a semi-circular cut-out portion 374. The semi-circular cut-out portion 374 is utilized to at least partially receive a locater pin that allows the rigid insert 313 to be securely positioned within the mold cavity during the molding process of the key 301.

Due to its construction, the rigid insert 313 illustrated in FIG. 37 has been found to function satisfactorily in at least certain types of automobile keys.

Figure 39:
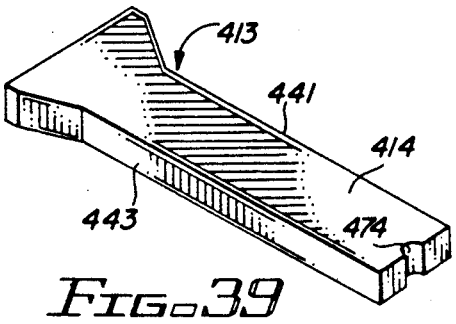
FIG. 39 is a perspective view of another embodiment of a rigid insert of the present invention.

Referring now to FIG. 39, a further embodiment of the rigid insert 413 is illustrated. In this embodiment, the insert 413 includes a body member 414. However, in contrast to the rigid insert 313 illustrated in FIGS. 36–38, the body member 414 does not include side portions having a reduced cross-sectional thickness, lying in different planes. Instead, the sidewalls 441 and 443 of the insert 413 lie in the same thickness plane. In certain applications, it may be desirable to use such a rigid insert 414.

As illustrated, at a front of the rigid insert 413, a semicircular cut-out portion 474 is provided. Again, the cut-out portion 474 provides means for cooperating with a locater pin to position the rigid insert 413 within a mold cavity.

Figure 40:
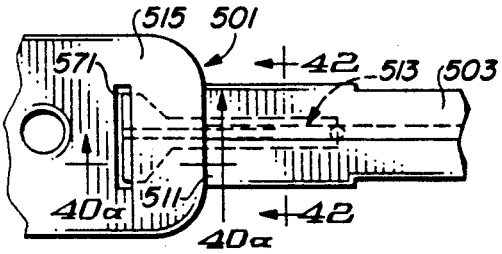
FIG. 40 is a plan view of another embodiment of a molded plastics material key and rigid insert of the present invention.
Figure 40A:
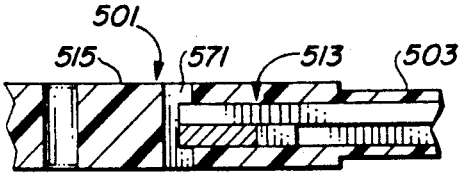
FIG. 40*a* is a cross-sectional view of a portion of the key of FIG. 40 taken along lines XXXXa—XXXXa of FIG. 40.
Figure 41:
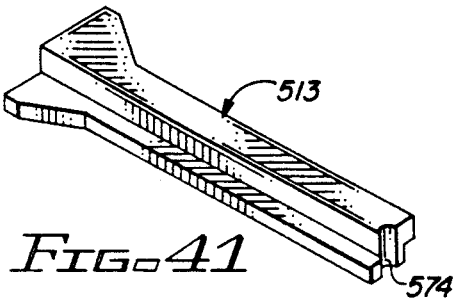
FIG. 41 is a perspective view of the rigid insert embodied in the molded plastics material key of FIG. 40.
Figure 42:
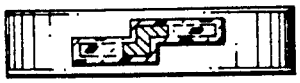
FIG. 42 is a cross-sectional view of the molded plastics material key of FIG. 40 taken along lines XXXXII—XXXXII of FIG. 40.
Figure 45:
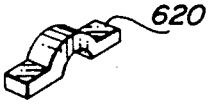
FIG. 45 is a perspective view of another portion of the rigid insert of the molded plastics material key of FIG. 43.
Figure 43:
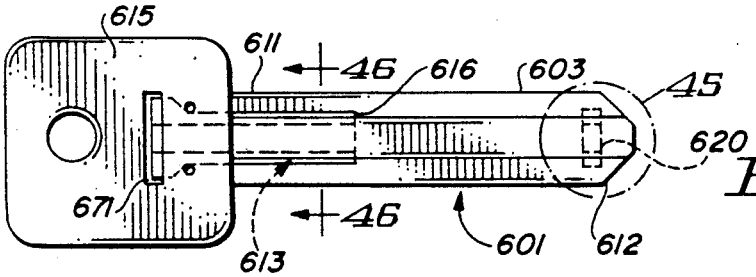
FIG. 43 is a plan view of another embodiment of a molded plastics material key and rigid insert of the present invention.
Figure 44:
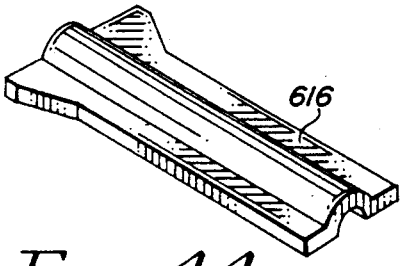
FIG. 44 is a perspective view of a portion of the rigid insert of the molded plastics material key of FIG. 43.
Figure 46:
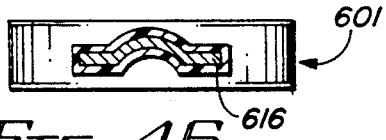
FIG. 46 is a cross-sectional view of the rigid insert embodied in the molded plastics material key of FIG. 43 taken along lines XXXXVI—XXXXVI of FIG. 43.

Referring now to FIGS. 40–42, a further embodiment of the molded plastics material key and means for reinforcing the key of the present invention is illustrated. In this embodiment, the rigid insert 513 is somewhat similar to the rigid insert 313 illustrated in FIGS. 36–38, but differs in that the width of the rigid insert 513 is smaller than that of the rigid insert 313 of FIG. 37. As illustrated, the center portion of the insert, the thickest portion, has a substantially smaller width than the center portion of the rigid insert 313 of FIG. 37.

The rigid insert 513 illustrated in FIGS. 40–42 is useful in certain applications wherein the thickest portion of the shank 511 of the key 501 is not great, and accordingly, the thickest portion of the insert must also be limited. To provide a viable insert, the rigid insert 513 has a somewhat Z-shaped cross-sectional construction with an offset center. This allows the rigid insert 513 to be used with keys 501 having a small cross-sectional thickness. As illustrated, the rigid insert 513 also includes, at an end thereof, a semicircular cut-out portion 574 for receiving a locater pin of a mold cavity.

As illustrated in FIG. 40*a* the key 501 includes means for stress relieving portions of the key adjacent the insert 513. The means includes a groove 571 that does not extend through the entire thickness of the key 501.

Referring now to FIGS. 43–46, a further embodiment of the molded plastics material key and means for reinforcing of the present invention is illustrated. The key illustrated in FIG. 43 has a construction somewhat similar to the construction of a key sold in Japan as the Miwa key. The Miwa key is constructed to cooperate with a lock and tumbler wherein although the sides of the bit actuate the tumbler, as in a typical key and lock construction, only the tip of the bit actuates the lock. Accordingly, it is necessary for a plastics material key, that is to be used on such locks, to be reinforced at the tip portion 612 of the key 601, as well as the shank 611, to ensure that the tip does not break if unusual torque or resistance is encountered as the tip actuates the lock.

To this end, the rigid insert 613 of the embodiment of the present invention illustrated in FIGS. 43–46 is preferably of a two piece construction. The first portion 616 of the rigid insert 613 is embedded within portions of the head 615 and shank 611 of the key 601. Again, a slot 671 is provided in the head 615 of the key 601 for stress relieving portions of the key 601 adjacent the rigid insert 613 and for providing a shelf for the rigid insert 613 during molding. As illustrated, the rigid insert 613 has a somewhat omega cross-sectional shape that corresponds to the cross-sectional shape of portions of the shank 611 and bit 603 of the key 601.

Located at a tip 612 of the bit 603 of the key 601 is a second portion 620 of the rigid insert 613. This portion 620 of the rigid insert 613 reinforces the tip of the key to prevent the tip 612 from breaking due to any torque that is exerted on the tip 612 when the tip 612 actuates the lock. Again, the second portion 620 of the rigid insert 613 has a cross-sectional shape that substantially corresponds to the cross-sectional portion of the tip 612 of the bit 603 within which it is received. Preferably, the second portion 620 of the rigid insert 613 is embedded in a portion of the bit 603 wherein the sides of the bit are not notched.

Figure 49:
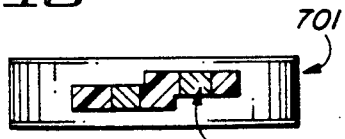
FIG. 49 is a cross-sectional view of the molded plastics material key of FIG. 47 taken along lines XXXXIX—XXXXIX of FIG. 47.
Figure 47:
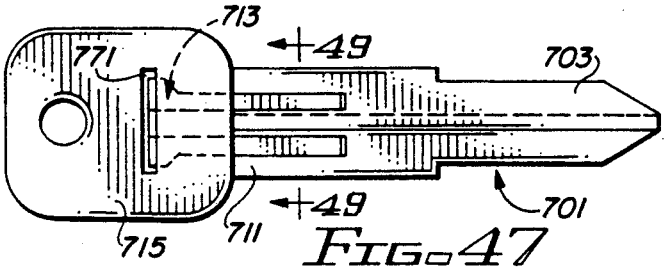
FIG. 47 is a plan view of another embodiment of a molded plastics material key having a rigid insert of the present invention.
Figure 48:
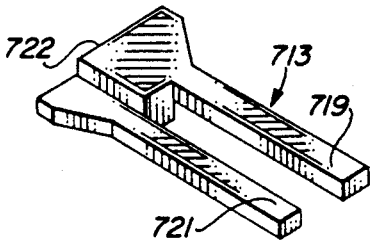
FIG. 48 is a perspective view of the rigid insert embodied in the molded plastics material key of FIG. 47.

Referring now to FIGS. 47–49, another embodiment of the molded plastics material key and reinforcement means of the present invention is illustrated. The rigid insert 713 of this embodiment is somewhat similar to the embodiment illustrated in FIGS. 25–27. To this end, the rigid insert 713 includes a body 715 having legs or fingers 719 and 721 extending therefrom. The fingers 719 and 721 have a reduced cross-sectional thickness when compared to a thickest part of the rigid insert 713.

In this embodiment, the fingers 719 and 721 of the rigid insert 713 extend from one end of the rigid insert to the head 722 of the rigid insert 713. Thus, the rigid insert 713 includes a reduced cross-sectional portion that extends from one end of the rigid insert to the head end. This allows the rigid insert to more easily slide or move within the plastics material during the cooling process and accordingly, substantially reduces the risk that the key will warp or distort during the cooling process.

From the foregoing it will be apparent that the present invention provides means that afford substantial reinforcement protection against torque damage to the critical areas of the molded plastic keys.

Although the teachings of my invention have herein been discussed with reference to specific theories and embodiments, it is to be understood that these are by way of illustration only and that others may wish to utilize my invention in different designs or applications.

I claim as my invention:

1. A flat plastic key for actuating a rotary cylinder lock having lock tumblers, an elongated key receptacle for receiving the key and a rotary lock face including a rectangular lock entrance slot with spaced apart sidewalls, the key and the lock including alignable longitudinal axes, the plastic key comprising:

a. a head for receiving a lock actuating input torque within a force input area and having an end surface, a head thickness, a head width and a head length;

b. a shank having a substantially rectangular cross section with substantially parallel sides defining a shank thickness, the shank further including a width, a length, a first end surface joined to the end surface of the head and a spaced apart second end surface, the shank thickness, width and length configured to enable the shank to extend through the entrance slot of the lock face when the key is fully inserted into the lock receptacle, the resulting area of overlap between the sides of the fully inserted shank and the lock entrance slot defining a shank torque transfer surface where torque is transferred from the shank to the sidewalls of the lock entrance slot;

c. a solid plastic bit having an edge surface for receiving notches to actuate the lock tumblers and including a thickness, a width and a first end surface joined to the second end surface of the shank, selected notches penetrating into the edge surface of the bit toward the key longitudinal axis by a first distance; and d. a rigid metal insert imbedded in the head and the shank of the key, having a thickness and rigidity adequate to resist torsional bending and a length less than the combined length of the head and the shank, the insert including an insert head section with an end displaced into the force input area of the key head and an insert shank section with an end terminating before the second end of the key shank;

whereby application of the lock actuating input torque to the force input area of the key head transfers the input torque through the plastic key head and key shank and through the head section and shank section of the rigid metal insert across the shank torque transfer surface to the sidewalls of the lock entrance slot to enable the lock actuating input torque to rotate the lock face and thereby actuate the lock while limiting torsional bending of the key head relative to the key shank.

2. The plastic key of claim 1 wherein the thickness of the rigid metal insert is uniform within the head and shank sections of the key.

3. The plastic key of claim 2 wherein the thickness of the rigid metal insert is approximately equal to the thickness of the notch receiving edge surface of the key bit.

4. The plastic key of claim 3 wherein the rigid metal insert includes parallel oriented first and second side surfaces defining the thickness of the insert.

5. The plastic key of claim 4 wherein the rigid metal insert includes a width defined by first and second spaced apart insert edges and wherein the width of the shank section of the rigid metal insert is substantially constant.

6. The plastic key of claims 1 or 5 wherein penetration of the notches into the notch receiving edge surface of the key bit at a selected notch location reduces the bit width at that notch location to a minimum bit width and wherein the width of the shank section of the rigid metal insert exceeds the minimum bit width.

7. The plastic key of claim 6 wherein the key shank includes first and second spaced apart edges defining the shank width and wherein the rigid metal insert is centrally located between the first and second edges of the key shank.

8. The plastic key of claim 7 wherein the insert shank section includes first and second spaced apart edges defining the width of the insert shank section.

9. The plastic key of claim 8 wherein the spacing between the first edge of the insert shank section and the key longitudinal axis is greater than the spacing between an edge which defines the minimum bit width and the key longitudinal axis.

10. The plastic key of claim 1 wherein the end of the insert shank section extends through and beyond the lock entrance slot when the key is fully inserted into the key receptacle of the lock.

11. A flat plastic key for actuating a rotary cylinder lock having lock tumblers, an elongated key receptacle for receiving the key and a rotary lock face including a rectangular lock entrance slot with spaced apart sidewalls, the key and the lock including alignable longitudinal axes, the plastic key comprising:

a. a head for receiving a lock actuating input torque within a force input area and having an end surface, a head thickness, a head width and a head length;

b. a shank having a substantially rectangular cross section with substantially parallel sides defining a shank thickness, the shank further including a width, a length, a first end surface joined to the end surface of the head and a spaced apart second end surface, the shank thickness, width and length configured to enable the shank to extend through the entrance slot of the lock face when the key is fully inserted into the lock receptacle, the resulting area of overlap between the sides of the fully inserted shank and the lock entrance slot defining a shank torque transfer surface where torque is transferred from the shank to the sidewalls of the lock entrance slot;

c. a solid plastic bit having an edge surface for receiving notches to actuate the lock tumblers and including a thickness, a width and a first end surface joined to the second end surface of the shank, wherein penetration of a selected notch into the notch receiving edge surface of the key bit at a selected notch location reduces the bit width at that notch location to a minimum bit width and wherein the width of the shank section of the key exceeds the minimum bit width; and d. a rigid metal insert imbedded in the head and the shank of the key, having a thickness at least approximately equal to or greater than the thickness of the notch receiving edge surface of the key bit, a rigidity adequate to resist torsional bending and a length less than the combined length of the head and the shank, the insert including parallel oriented first and second side surfaces defining the insert thickness, an insert head section with an end displaced into the force input area of the key head and an insert shank section with an end terminating before the second end of the key shank, the insert shank section further including first and second spaced apart edges defining a width of the insert shank section, wherein the spacing between the first edge of the insert shank section and the key longitudinal axis is greater than the spacing between an edge which defines the minimum bit width and the key longitudinal axis;

whereby application of the lock actuating input torque to the force input area of the key head transfers the input torque through the plastic key head and key shank and through the head section and shank section of the rigid metal insert across the shank torque transfer surface to the sidewalls of the lock entrance slot to enable the lock actuating input torque to rotate the lock face and thereby actuate the lock while limiting torsional bending of the key head relative to the key shank.

12. The plastic key of claim 11 wherein the end of the insert shank section extends through and beyond the lock entrance slot when the key is fully inserted into the key receptacle of the lock.

* * * * *